United States Patent [19]

Oyama

[11] Patent Number: 5,067,221

[45] Date of Patent: Nov. 26, 1991

[54] METHOD OF AND APPARATUS FOR ASSEMBLING SLIDE FASTENER SLIDERS

[75] Inventor: Yoshio Oyama, Toyama, Japan

[73] Assignee: Yoshida Kogyo K.K., Tokyo, Japan

[21] Appl. No.: 687,628

[22] Filed: Apr. 19, 1991

[30] Foreign Application Priority Data

Apr. 20, 1990 [JP] Japan ..... 2-106270

[51] Int. Cl.[5] ..... E21D 53/54; A41H 37/06

[52] U.S. Cl. ..... 29/409; 29/766

[58] Field of Search ..... 29/408, 409, 766, 768, 29/33.2

[56] References Cited

U.S. PATENT DOCUMENTS

| | | | |
|---|---|---|---|
| 2,354,690 | 8/1944 | Lawson | 29/768 |
| 2,693,217 | 11/1954 | Lange | 29/766 |
| 2,825,126 | 3/1958 | Legat et al. | 29/409 |
| 3,234,635 | 2/1966 | Jakob | 29/766 |

FOREIGN PATENT DOCUMENTS 25563 6/1984 Japan .

*Primary Examiner*—P. W. Echols

*Attorney, Agent, or Firm*—Hill, Van Santen, Steadman & Simpson

[57] ABSTRACT

A method of and an apparatus for assembling a slide fastener slider by fitting together a slider body having an attachment lug provided on the upper surface thereof and a pull tab having an aperture in the one end thereof. There is a large enough gap between a distal end of the attachment lug and the upper surface of the slider body to allow the distal end to pass through the aperture of the pull tab. The method is characterized by gradually pressing the distal end of the attachment lug toward the slider body as the slider body is transported along the transport path by using feed rollers having combined functions to constitute a die and to transport the slider body thereon as well as a punch roller.

8 Claims, 5 Drawing Sheets

METHOD OF AND APPARATUS FOR ASSEMBLING SLIDE FASTENER SLIDERS

BACKGROUND OF THE INVENTION

1. Field of the Invention

The present invention relates to a method of and apparatus for assembling a slide fastener slider by fitting a slider body and a pull tab together.

2. Description of the Prior Art

A typical apparatus for assembling a slider of the type described is disclosed in Japanese Patent Publication No. Hei 1-25563. The conventional apparatus comprises a pair of juxtaposed slant chutes, namely, the first chute for feeding a series of slider bodies from a slider body hopper to one end of a horizontal transport path and the second chute for feeding a series of pull tabs from a pull tab hopper to a position above the transport path a little ahead of the path end. The leading slider body rests flat on the transport path with its attachment lug opened forward, while the leading pull tab hangs at the end of the second chute via its own gravity with its attachment aperture directed downward ready to be caught by the opened lug of the slider body. The leading slider body is pushed forward by a pusher horizontally along the transport path, thus causing the distal end of the attachment lug on the slider body to catch the aperture of the leading pull tab hanging from above. Thereafter, the attachment lug's catching the pull tab is detected by detecting means. In response to the detection, the slider body completely stops immediately under a presser rod; an anvil member advances along the transport path from its opposite end to intrude into the slider body; and subsequently the presser rod descends to press down the distal end of the attachment lug. As a result, the pull tab is pivotally joined to the attachment lug on the slider body. Thereafter, the anvil member retracts from under the presser rod, while holding the assembled slider thereon and then discharges the assembled slider through a withdrawal exit of the apparatus.

In the conventional apparatus, it is absolutely necessary to first detect the attachment lug's catching the pull tab and then to control the transportation of the slider body such that the slider body completely stops immediately under the presser rod. Furthermore, it is only after the slider body stops immediately under the presser rod and the anvil member advance along the transport path from its opposite end to intrude into the slider body that the presser rod descends to press down the attachment lug. This means that the slider body is transported along the transport path intermittently not continuously on the apparatus, thus limiting the enhancement of production efficiency.

SUMMARY OF THE INVENTION

With the foregoing difficulties in view, it is therefore an object of the present invention to provide a method of and an apparatus for assembling a slider wherein a slider body never stops on a transport path so that the slider body is assembled while transported continuously along a transport path so that the production efficiency of the slider is greatly enhanced.

According to the first aspect of the present invention, slider by fitting together a slider body having an attachment lug provided on the upper surface thereof and a pull tab having an aperture in the one end thereof, there being a large enough gap between a distal end of the attachment lug and the upper surface of the slider body to allow the distal end to pass through the aperture of the pull tab, the method comprising the steps of: transporting the slider body along a transport path continuously with the distal end of the attachment lug directed forward; placing a pull tab on the transport path with the aperture disposed in registry with the path of the distal end to cause the distal end of the attachment lug to catch the aperture of the pull tab while the slider body is transported along the transport path; and gradually pressing the distal end of the attachment lug toward the slider body as the slider body is transported along the transport path, so as to join the pull tab to the slider body.

According to the second aspect of the present invention, there is provided an apparatus for assembling a slide fastener slider by fitting together a slider body having an attachment lug provided on the upper surface thereof and a pull tab having an aperture in the one end thereof, there being a large enough gap between a distal end of the attachment lug and the upper surface of the slider body to allow the distal end to pass through the aperture of the pull tab, the apparatus comprising: a base; a transport channel provided on the base to transport the slider body along a transport path; a first chute communicating with the transport channel adjacent its one end for feeding the slider body into the transport channel with the distal end of the attachment lug directed forward; a second chute communicating with the transport channel downstream of the first chute for feeding the pull tab to the transport channel and placing the pull tab thereon with the aperture thereof in registry with the path of the distal end of the attachment lug; a pusher mounted reciprocally movable on and along the transport channel beyond the second chute to cause the distal end of the attachment lug to catch the aperture of the pull tab; means disposed downstream of the second chute and driven for continuous rotation for transporting the slider body thereon continuously and constituting a die; and a punch roller rotatably mounted on a horizontal axle provided over the transporting-and-die-constituting means and disposed normal to the transport channel to gradually press the distal end of the attachment lug toward the transporting-and-die-constituting means.

Many other advantages and features of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE DRAWINGS

FIG. 2 is an exploded perspective view of a slider to perform a method according to the present invention on.

DETAILED DESCRIPTION

Figure 1:
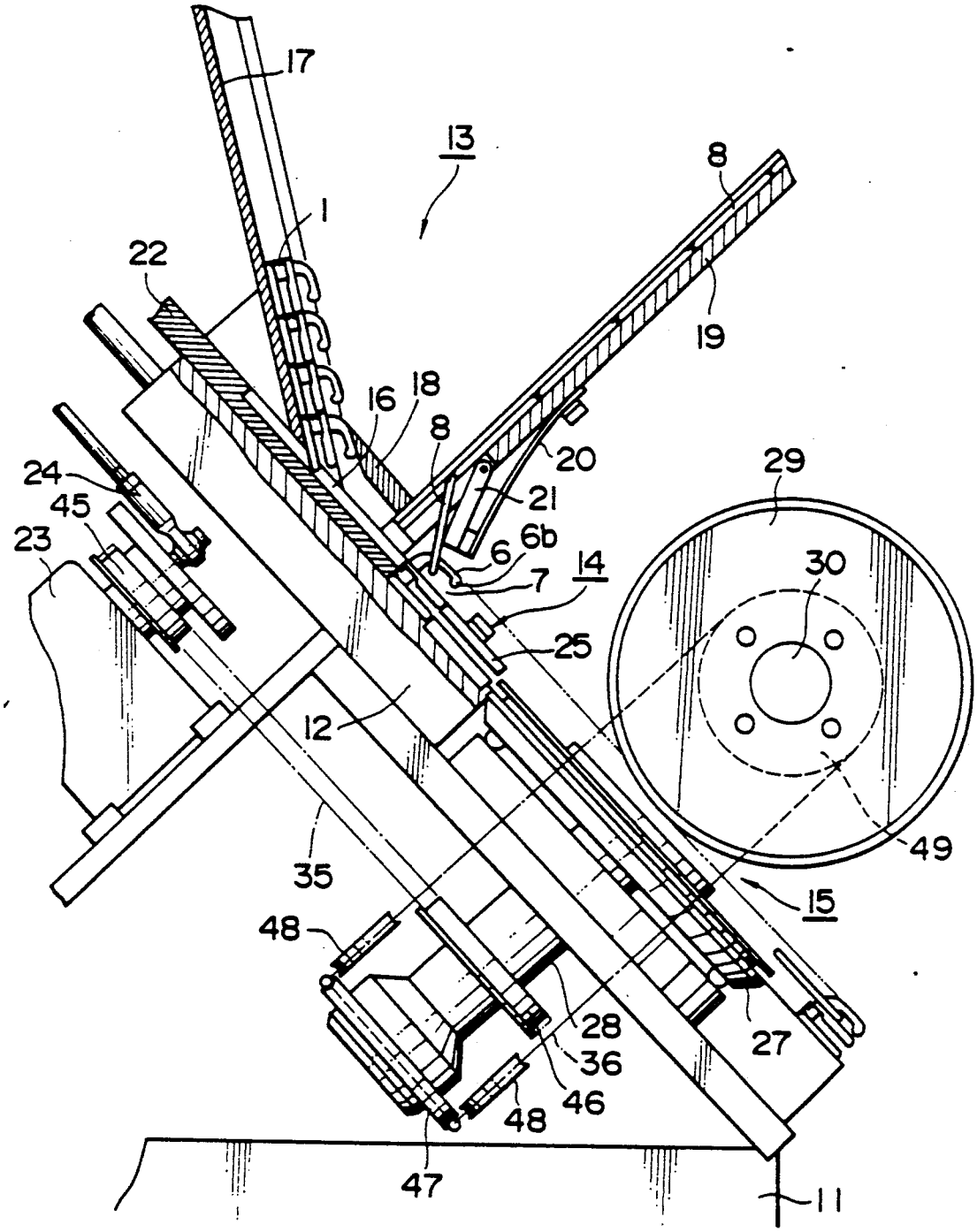
FIG. 1 is a side view cutaway in part of an apparatus according to the present invention.

As better shown in FIG. 1, an apparatus according to the present invention broadly comprises a frame 11, a base fixed to the frame 11 in inclined relation thereto, a transport channel 16 mounted on the base 12 and several parts provided on and along the transport channel 16; that is, as named downstream along the transport path, a first chute 17 for slider bodies 1 and a second chute 19 for pull tabs 8, burring means 14 and an attachment-lug-closing mechanism 15.

Figure 2:
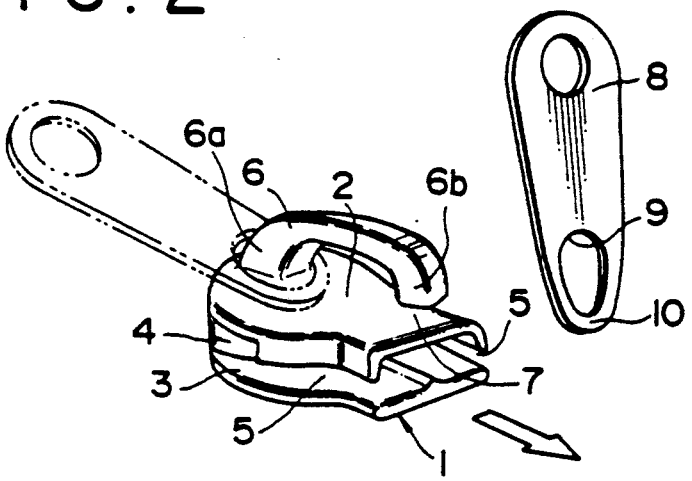

Referring to the constructions of a slider body 1 and a pull tab 8 to perform a method according to the present invention on, the slider body 1 is made by casting or die-casting and, as better shown in FIG. 2, comprises an upper wing 2 and a lower wing 3 integrally joined at their one ends by a diamond or neck portion 4 so as to be parallel with each other. There are side slits 5, 5 on both sides and between the upper and lower wings 2, 3 of the slider body 1, the side slits 5, 5 being adapted to allow opposed stringer tapes (not shown) to pass therethrough during the slider's reciprocation through fastener stringers (neither shown). An arcuate attachment lug 6 is provided on the upper surface of the upper wing 2. The pull tab 8 to be attached to the slider body 1 is in the shape of a flat strip. The pull tab 8 has an aperture 9 formed adjacent its one end to thus leave a pivotal axle 10 at its one end. It is to be noted that, as better shown in FIG. 2, there is a large enough gap 7 between a distal end 6*b* of the attachment lug 6 and the upper surface of the slider body 1 to allow the distal end 6*b* to pass through the aperture 9 of the pull tab 8.

The transport channel 16 is mounted on the inclined base 12 to transport slider bodies 1 one by one along a transport path. The first chute 17 communicates with the transport channel 16 adjacent its one end for feeding a series of slider bodies 1 into the transport channel 16 with the distal end 6b of the attachment lug 6 directed forward. The second chute 19 communicates with the transport channel 16 downstream of the first chute 17 for feeding a series of pull tabs 8 with its apertured end down to the transport channel 16 and holding a lowermost pull tab 8 with the aperture 9 thereof in registry with the path of the distal end 6*b* of the attachment lug 6, as closely described hereinafter. As better shown in FIG. 1, the first chute 17 is disposed in slant relation to the transport channel 16, while the second chute 19 is disposed perpendicular to the transport channel 16.

A suppressing guide 18 is provided on the rear wall of and adjacent to the lower end of the second chute 19 in such a way to extend rearwardly therefrom over the lower end of the first chute 17 in order to prevent a lowermost slider body 1 from accidentally coming off the first chute 17.

The second chute 19 has a shutter 21 pivotally mounted on the front wall of and adjacent the lower end thereof. The shutter 21 is normally urged toward the rear wall of the second chute 19 by a plate spring 20 fixed to the forward side of the second chute 19 so as to resiliently hold a lowermost pull tab 8 with the aperture 9 in registry with a path of the distal end 6*b* of the attachment lug 6.

A pusher 22 is mounted on the transport channel 16 so as to reciprocate along the transport channel 16 toward and away from burring means 14 described closely hereinafter. The pusher 22 is driven by a motor 23 via any suitable linking mechanism such as for example a crank 24 shown in FIG. 1. After reaching the most forward position, the pusher 22 retracts to the most rearward position along the transport path. As soon as the pusher 22 passes by the lower end of the first chute 17 during the retraction, a lowermost slider body 1 slides down the first chute 17 into the transport channel 16 via its own gravity. On the other hand, a lowermost pull tab 8 is resiliently held against the rear wall by the shutter 21 at the lower end of the second chute 19 with the aperture 9 held in registry with the path of the distal end 6*b* of the attachment lug 6 of the slider body 1. The pusher 22 forcibly pushes forwards the slider body 1 which starts to slide forwards slowly along the inclined transport channel 16 via its own gravity. Pushing the slider body 1 beyond the lower end of the second chute 19 causes the distal end 6*b* of the attachment lug 6 of the slider body 1 to first catch the aperture 9 of the pull tab 8 and to then pull the slider body 1 off the second chute 19 against the resiliency of the plate spring 20.

Figure 3:
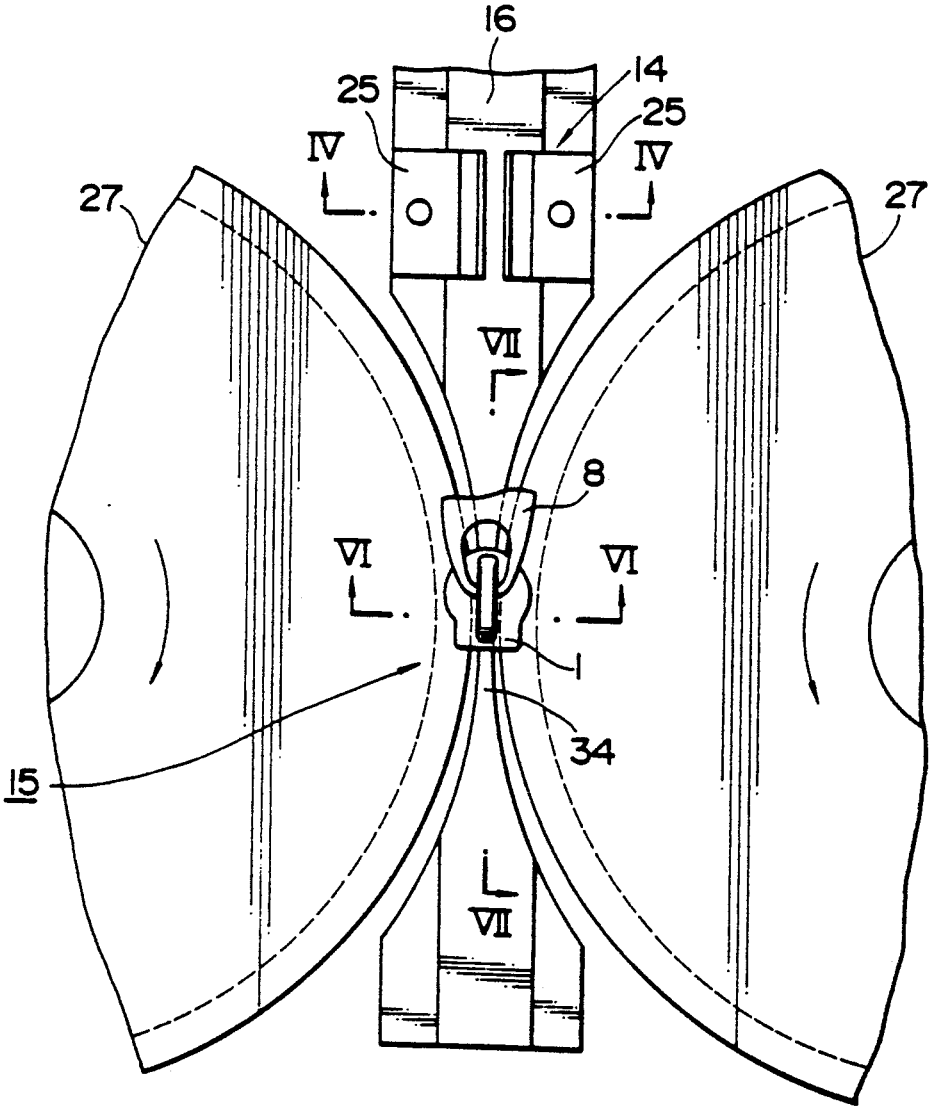
FIG. 3 is a fragmental plan view of burring means and transporting-and-die-constituting means.
Figure 4:
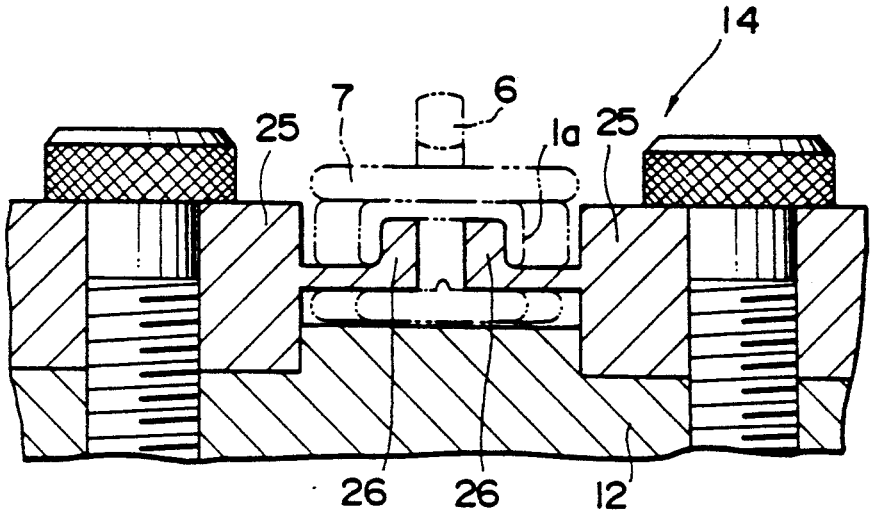
FIG. 4 is an enlarged cross-sectional view taken on line IV—IV of FIG. 3, showing the burring means.
Figure 5A:
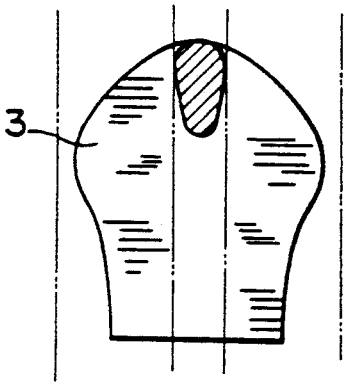
FIG. 5 (A) and FIG. 5 (B) are enlarged views of inner sides of a lower wing and an upper wing, respectively, of the slider body to show what part of the slider body is burred.
Figure 5B:
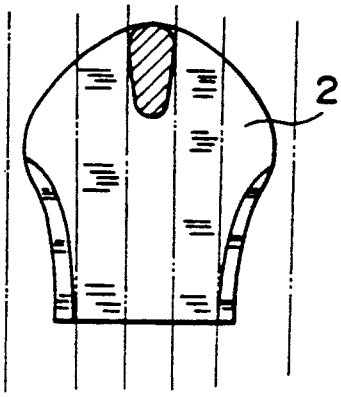

Reference numeral 14 denotes burring means for removing burs left on interior sides of the upper and lower wings 2, 3 of the slider body 1 during the transportation of the slider body 1 therethrough. As better shown in FIGS. 3 and 4, the burring means 14 comprises a pair of trimming die 25, 25 one mounted on each side of the transport channel 16. The trimming dies 25, 25 have the respective trimming blades 26, 26 protruding from the opposed sides thereof towards each other. Each trimming blade 26 is so shaped as to snugly fit through the side slit 5 into the inner side of the slider body 1. Continued push by the pusher 22 of the slider body 1 through the burring means 14 causes the trimming blades 26, 26 to bur the inner side of the slider body 1, as indicated by the two-dotted lines and hatching in FIGS. 5(A) (Lower wing 3) and FIG. 5(B) (Upper wing 2).

Figure 6:
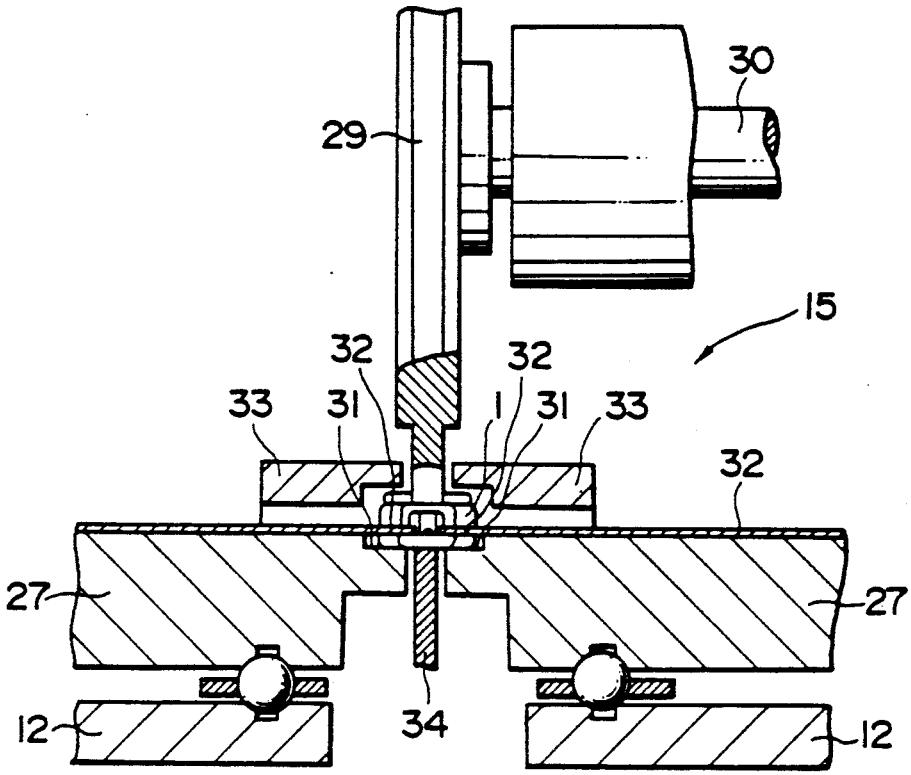
FIG. 6 is an enlarged cross-sectional view taken on line VI—VI of FIG. 3, showing the transporting-and-die-constituting means.
Figure 7:
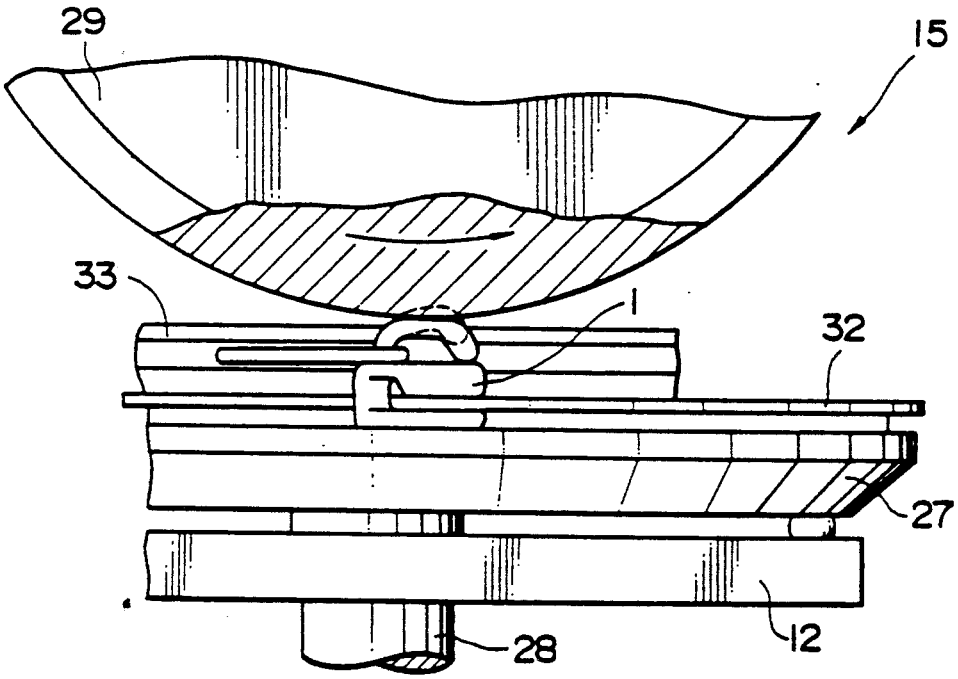
FIG. 7 is an enlarged cross-sectional view taken on line VII—VII of FIG. 3.

FIGS. 6 and 7 illustrate the attachment-lug-closing mechanism 15. Although these drawings are cross-sectional view, the slider body 1 and the pull tab 8 are shown in solid lines not broken lines for clarity's sake. The attachment-lug-closing mechanism 15 is intended for closing the distal end 6b of the attachment lug 6, to thus keep the pull tab 8 from getting detached from the slider body 1. As better shown in FIGS. 6 and 7, the attachment-lug-closing mechanism 15 generally comprises a pair of feed rollers 27, 27 and a punch roller 29 coacting with each other for the above-mentioned purpose. The feed rollers 27, 27 are disposed in horizontal confronting relation to each other across the transport channel 16. The feed rollers 27, 27 are fixed to respective axles 28, 28 rotatably mounted perpendicularly on the base 12. The feed rollers 27, 27 have peripheral steps 31 in the respective upper peripheral corner to jointly function as dies while transporting the slider body 1 thereon. A pair of disks 32, 32 are attached coaxially to the respective feed rollers 27, 27 on their upper sides. The peripheral edges of the disks 32, 32 fit through the opposed side slits 5, 5 of the slider body 1 transported by the peripheral steps 31, 31 of the feed rollers 27, 27 in order to guide the slider body 1 during the transportation and to prevent the slider body 1 from being squeezed by a punch roller 29 described hereinafter. As shown in FIG. 6, a pair of guide plates 33, 33 are mounted on the base 12 so as to cover the opposed peripheral portions of the feed rollers 27, 27. Furthermore, an upstanding support member 34 stands on the base 12 to protrude upward through between the opposed peripheral edges of the feed rollers 27, 27. The support member 34 supports on its top the slider body 1 transported by the peripheral steps 31, 31 of the feed rollers 27, 27, as shown in FIG. 6. Although the support member 34 should appear in FIG. 7, too, it has been omitted for brevity. One of the feed rollers 27, 27 is driven by the motor 23 via a timing belt 5 wound around a pulley 45 mounted on the motor 23 and another pulley 46 mounted on the axle 28. The two feed rollers 27, 27 are operatively linked with each other by an intermediate spur gear (not shown) to rotate so as to transport therebetween the slider body 1 downstream. A punch roller 29 is mounted on a horizontal axle 30 which is normal to the transport channel 16. The punch roller 29 is disposed immediately over between the opposed peripheries of feed rollers 27, 27. The punch roller 29 is driven for rotation by the motor 23 via a timing belt 36 running around a pulley 47 mounted on the axle 28, through a pair of intermediate pulleyes 48, 48 and then around a pulley 49 mounted on the the horizontal axle 30.

Figure 8:
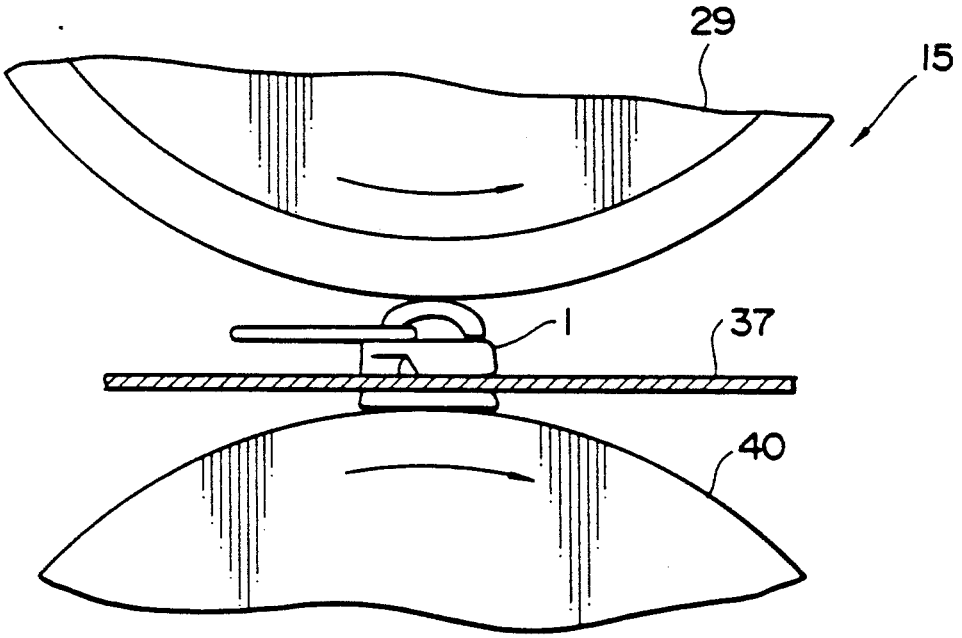
FIG. 8 is a view similar to FIG. 7 but showing another embodiment.

FIG. 8 shows another embodiment of the present invention. This embodiment is substantially identical with the preceding embodiment except that only one feed roller 40 is mounted on an axle parallel with the horizontal axle 30 of the punch roller 29. In order to guide the slider body 1 during the transportation by the feed roller 40 and to prevent the slider body 1 from being squeezed by a punch roller 29, a pair of elongated guide strips 37, 37 are provided one on each side of the transport path so as to extend over the attachment-lug-closing mechanism 15. The guide strips 37, 37 have their opposed edges fit through the respective side slits 5 of the slider body 1 transported through between the punch roller 29 and the feed roller 40.

It is to be noted that the distal end **6*b* of the attachment lug 6 of the slider body 1 is gradually pressed toward the peripheral steps 31, 31 of the feed rollers 27, 27 by the punch roller 29, as the slider body 1 is transported by the peripheral steps 31, 31 of the feed rollers 27, 27, so that the pull tab 8 is joined with the slider body 1**.

Although shown to be driven by the motor 23, the punch roller 29 may be disposed for free rotation.

With the construction of the present invention stated above, the method and apparatus according to the present invention can enjoy the following advantages:

While transporting slider bodies 1 along a transport path continuously, the apparatus can cause an attachment lug 6 to catch a pull tab 8 and then close the attachment lug 6 to thus firmly join the pull tab 8 to the slider body 1 continuously. There is no need whatsoever for detecting the attachment lug's catching the pull tab 8 and controlling timing between the pull-tab-catching step and the attachment-lug-closing step. Consequently, the assembling operation of the sliders 1 can be carried out at higher speed. Since the apparatus need not be equipped with detective means and controlling means, the apparatus is the less liable to breakdown and malfunction.

The slider body 1 slides down the inclined transport channel 16 via its own gravity, so that the transporation of the slider body 1 is the more certain and smooth. Consequently, the assembing of the sliders can be carried out at higher speed.

Since the feed roller 40 or feed rollers 27, 27 has combined functions to constitute a die and to transport the slider body 1 thereon, the attachment-lug-closing operation can be effected while the slider body 1 is transported continuously along the transport path. Consequently, the assembling of the sliders can be carried out at higher speed.

Since the attachment-lug-closing operation is carried out by the punching roller 29 and feed rollers 37, 37; 40 in the apparatus according to the present invention, the operation causes much less clash or noise than by a vertically-movalble punch in a conventional slider assembling apparatus.

Obviously, various modifications and variations of the present invention are possible in light of the the above teaching. It is therefore to be understood that within the scope of the appended claims the invention may be practiced otherwise than as specifically described.

What is claimed is:

1. A method of assembling a slide fastener slider by fitting together a slider body having an attachment lug provided on the upper surface thereof and a pull tab having an aperture in one end thereof, there being a large enough gap between a distal end of the attachment lug and the upper surface of the slider body to allow the distal end to pass through the aperture of the pull tab, the method comprising the steps of:

(a) transporting the slider body along a transport path continuously with the distal end of the attachment lug directed forward;

(b) placing a pull tab on the transport path with the aperture disposed in registry with the path of the distal end to cause the distal end of the attachment lug to catch the aperture of the pull tab while the slider body is transported along the transport path; and (c) gradually pressing the distal end of the attachment lug toward the slider body as the slider body is transported along the transport path, so as to join the pull tab to the slider body.

2. A method according to claim 1, the transport path being inclined downwardly downstream to the horizon.

3. An apparatus for assembling a slide fastener slider by fitting together a slider body having an attachment lug provided on the upper surface thereof and a pull tab having an aperture in the one end thereof, there being a large enough gap between a distal end of the attachment lug and the upper surface of the slider body to allow the distal end to pass through the aperture of the pull tab, the apparatus comprising:

(a) a base;

(b) a transport channel provided on the base to transport the slider body along a transport path;

(c) a first chute communicating with the transport channel adjacent its one end for feeding the slider body into the transport channel with the distal end of the attachment lug directed forward;

(d) a second chute communicating with the transport channel downstream of the first chute for feeding the pull tab to the transport channel and placing the pull tab thereon with the aperture thereof in registry with the path of the distal end of the attachment lug;

(e) a pusher mounted reciprocally movable on and along the transport channel beyond the second chute to cause the distal end of the attachment lug to catch the aperture of the pull tab;

(f) means disposed downstream of the second chute and driven for continuous rotation for transporting the slider body thereon continuously and constituting a die; and (g) a punch roller rotatably mounted on a horizontal axle provided over the transporting-and-die-constituting means and disposed normal to the transport channel to gradually press the distal end of the attachment lug toward the transporting-and-die-constituting means.

4. An apparatus according to claim 3, the transporting-and-die-constituting means comprises a pair of feed rollers disposed in confronting relation to each other across the transport channel and mounted on respective axles disposed perpendicular to the plane of the base; the feed rollers having in the respective upper peripheral corner peripheral steps to jointly function as dies while transporting the slider body thereon.

5. An apparatus according to claim 4, the slider body comprising an upper wing and a lower wing integrally joined by a diamond at their one ends, there being side slits on the opposite sides and between the upper and lower wings of the slider body; the apparatus further including a pair of disks provided coaxially on the respective rollers on their upper sides, each disk having its periphery fit through the side slit of the slider body transported by the steps.

6. An apparatus according to claim 3, the transporting-and-die-constituting means comprises a roller disposed in vertical confronting relation to the punch roller and mounted on an axle disposed parallel to the horizontal axle; the roller having its peripheral surface to function as a die while transporting the slider body thereon.

7. An apparatus according to claim 6, the slider body comprising an upper wing and a lower wing integrally joined by a diamond at their one ends, there being side slits on the opposite sides and between the upper and lower wings of the slider body; the apparatus further including a pair of elongated guide strips provided one on each side of the transport path and disposed between the punch roller and the feed roller for fitting through the side slits of the slider body transported through between the punch roller and the feed roller.

8. An apparatus according to any of claims 3, 4, 5, 6 and 7, the transport channel being inclined downwardly downstream to the horizon.

* * * * *